US006311854B1

(12) United States Patent
Anderson

(10) Patent No.: US 6,311,854 B1
(45) Date of Patent: Nov. 6, 2001

(54) SLATBOARD ANCHOR BLOCK FOR TOOL HOLDER

(76) Inventor: David A. Anderson, 7125 48th St. North, Oakdale, MN (US) 55128

( * ) Notice: Subject to any disclaimer, the term of this patent is extended or adjusted under 35 U.S.C. 154(b) by 0 days.

(21) Appl. No.: 09/643,088

(22) Filed: Aug. 21, 2000

Related U.S. Application Data

(60) Provisional application No. 60/158,464, filed on Oct. 8, 1999.

(51) Int. Cl.[7] ..... A47F 5/00

(52) U.S. Cl. ..... 211/70.6; 211/87.01; 211/94.01; 248/225.11

(58) Field of Search ..... 211/94.01, 87.01, 211/106, 70.6; 248/229.21, 229.11, 225.11, 222.13, 222.14, 223.41

(56) References Cited

U.S. PATENT DOCUMENTS

| | | | | |
|---|---|---|---|---|
| 3,610,425 | * | 10/1971 | Madey . | |
| 3,829,050 | * | 8/1974 | Brautaset et al. . | |
| 4,591,058 | | 5/1986 | Amstutz | 211/94 |
| 4,629,076 | | 12/1986 | Amstutz | 211/94 |
| 4,635,801 | | 1/1987 | Oren | 211/70.6 |
| 4,687,094 | | 8/1987 | Allsop | 206/44 |
| 4,708,311 | | 11/1987 | Clausen | 248/222.2 |
| 4,805,784 | | 2/1989 | Solheim | 211/94 |
| 4,903,928 | * | 2/1990 | Shell | 248/225.11 |
| 5,038,946 | | 8/1991 | Tenser | 211/168 |
| 5,142,832 | * | 9/1992 | Branham et al. | 211/87.01 X |
| 5,228,579 | | 7/1993 | Kaufman | 211/94 |
| 5,259,519 | | 11/1993 | Lieberman | 211/66 |
| 5,375,802 | * | 12/1994 | Branham | 211/94.01 X |
| 5,412,912 | | 5/1995 | Alves | 52/36.5 |
| 5,582,376 | | 12/1996 | Thompson | 248/214 |
| 5,897,002 | | 4/1999 | Carlino | 211/70.6 |
| 6,105,794 | * | 8/2000 | Bauer | 211/94.01 |

* cited by examiner

*Primary Examiner*—Robert W. Gibson, Jr.
(74) *Attorney, Agent, or Firm*—Jacobson & Johnson

(57) ABSTRACT

A tool hanging system utilizing a slatboard and an anchor block that is frictionally engageable with the slatboard, with the anchor block having a ledge and a channel to cantileverly support a tool hanger fixture.

11 Claims, 3 Drawing Sheets

SLATBOARD ANCHOR BLOCK FOR TOOL HOLDER

This application claims the benefit of provisional application No. 60/158,464, filed Oct. 8, 1999.

FIELD OF THE INVENTION

This invention relates generally to tool hanging systems and more particularly to anchor blocks for supporting tool holders in a slatboard

BACKGROUND OF THE INVENTION

Traditional, organizing and hanging tools have been done in a variety of ways. One of the most popular ways is by using a "pegboard" panel in which wire S-hooks and brackets with bent ends forming mounting elements are supped in rows of holes spaced apart on a flat board. The used of the pegboard and S-hooks can be unreliable because the pegs can be burdensome to install and in certain instances may not provide for an adequate hold of certain articles.

The current invention is an innovative way to organize and hang tools by using an anchor block system in which J-hooks or straight hooks are placed within the U-shape channel of the anchor blocks. The anchor blocks and hooks are then slipped into slots located within the slatboard and are secured to the slatboard by the rotational engagement of a fastener, the fastener allows the anchor block to be easily loosened and moved to a different position. The anchor system can also hold trays for miscellaneous tools and parts bins.

DESCRIPTION OF THE PRIOR ART

U.S. Pat. No. 5,897,002 shows a tool hanging rack for attachment to a vertical surface with the tool hangers comprising bent hooks that fit into a c-shaped channel.

U.S. Pat. No. 4,687,094 discloses a pegboard hanging system for hanging containers from a pegboard.

U.S. Pat. No. 4,591,058 discloses a slatboard with hooks for engaging the T-shape slots in the slatboard.

U.S. Pat. No. 5,582,376 discloses a multiple function bracket for hanging on a slatboard.

U.S. Pat. No. 5,038,946 discloses a T-shaped hanger for insertion into the T-shaped slot of a slatboard to provide a horizontally extending hanger.

U.S. Pat. No. 5,259,519 discloses a disposable toothbrush holder with a T-shaped projection that fits into a holder to enable toothbrushes to be held in a sanitary condition.

U.S. Pat. No. 4,635,801 discloses a locking device for engaging a channel to hold the device in place.

U.S. Pat. No. 5,228,579 discloses a merchandise display panel having slats and grooves for supporting hangers therefrom.

U.S. Pat. No. 5,412,912 discloses a modular slatwall assembly utilizing T-shaped slots.

U.S. Pat. No. 4,708,311 discloses a slot board hanging apparatus that has a hook that engages one of the lips of the slatboard.

U.S. Pat. No. 4,629,076 discloses a slatboard that has metal hooks for engaging the T-shaped slots in the slatboard.

U.S. Pat. No. 4,805,784 discloses a slatboard mounting device that can be secured to the lips on a slatwall.

BRIEF SUMMARY OF THE INVENTION

A tool hanging system utilizing a slatboard and an anchor block with a threaded fastener, a tool holder fixture, whereby the anchor block and the tool holder fixture frictionally engages the slatboard, with the anchor block having a ledge and a channel to cantileverly support a tool hanger fixture therein with the tool hangers fixture frictionally secured to the slatboard by the rotational engagement of the fastener.

DESCRIPTION OF THE PREFERRED EMBODIMENT

The complete assembly of the present invention comprises a slatboard and an anchor block with a fastener, a tool hanger fixture having J-hooks, straight hooks or the like. The combination of these parts create a hanging system whereby the anchor block frictionally engages with the slatboard, with the anchor block having a ledge and a channel to cantileverly support a tool hanger fixture therein with the tool hanger fixture frictionally secured to the slatboard by the engagement of a single fastener, allowing articles to be hung and organized on the slatboard.

Figure 1:
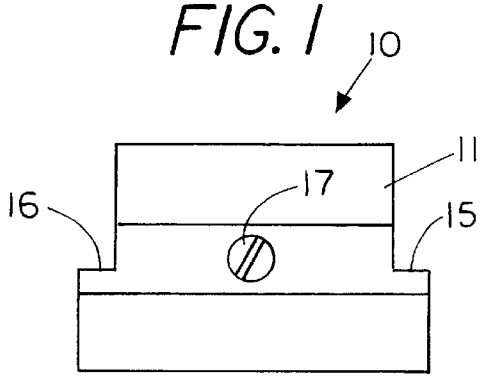
FIG. 1 is front view of an anchor block for securing a tool holder to a slatboard.
Figure 2:
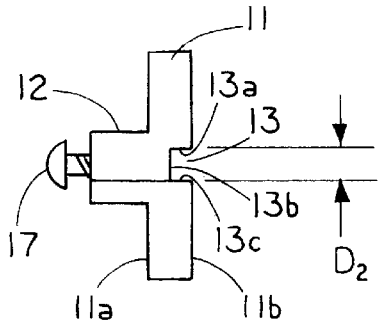
FIG. 2 is a side view of the anchor block of FIG. 1.

FIG. 1 is front view of an anchor block 10 for securing a tool holder to a slatboard and FIG. 2 is a side view of the anchor block of FIG. 1. The anchor block 10 having a base 11 with a surface engaging top surface 11*a* and a surface engaging bottom surface 11*b*. Located in anchor block 10 is an elongated U-shaped channel 13. Channel 13 has an upper surface 13*a*, a lower surface 13*b* and a back surface 13*c* with the elongated U-shaped channel extending transverse to base 11. The shape of channel 13 allows the channel to hold a cross-arm of a tool hanger fixture. Anchor block 10 has a neck 12 extending from base 11 so as to form a T-shape. A threaded opening (not shown) extends perpendicularly through neck 12 and base 11 with the threaded opening terminating at the back surface 13*c* of the elongated channel 13. A threaded fastener 17 comprises a pan head bolt or like that forms threaded engagement with the threaded opening to permit one to axially extend the threaded fastener into and out of the threaded opening. The anchor block 11 has a first ledge 15 and a second ledge 16 located on the neck 12 and the base 11 with the ledges forming a support surface.

Figure 3:
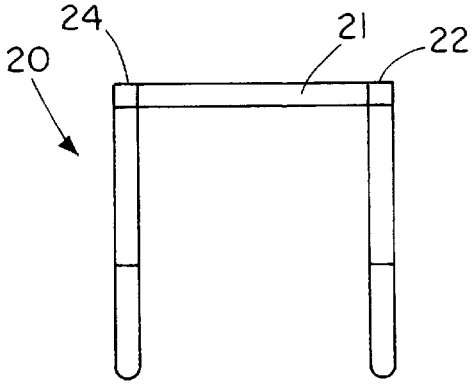
FIG. 3 is a front view of a double hook having one end for engagement with the anchor block of FIG. 1 and FIG. 2 and the other end for supporting a tool thereon.
Figure 4:
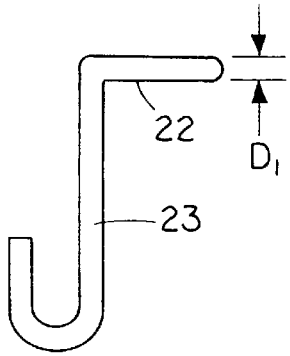
FIG. 4 is a side view of the double hook of FIG. 3.

FIG. 3 and FIG. 4 show a tool hanger 20 with the tool hanger 20 having a tool hook 23 for holding articles. Tool hanger 20 can be formed from a cylindrical member such as a wire. Tool hanger 20 has a first extension 22 and a second extension 24 with a cross arm 21 extending therebetween. The extensions of hanger 23 allow hanger 23 to be capable of holding articles of various sizes. The cross arm has an outside dimension $D_1$ which is smaller than the width $D_2$ of U-shaped channel 13 to enable the cross arm to be snugly positioned within the elongated channel 13 while the first extension 22 is supported by first ledge 15 and the second extension 24 is supported by second ledge 16 with the upper channel surface 13*a* forming a tool hook pressure surface to enable tool hanger 20 to extend in a cantilevered manner from base 11 and ledges 15 and 16.

Figure 5:
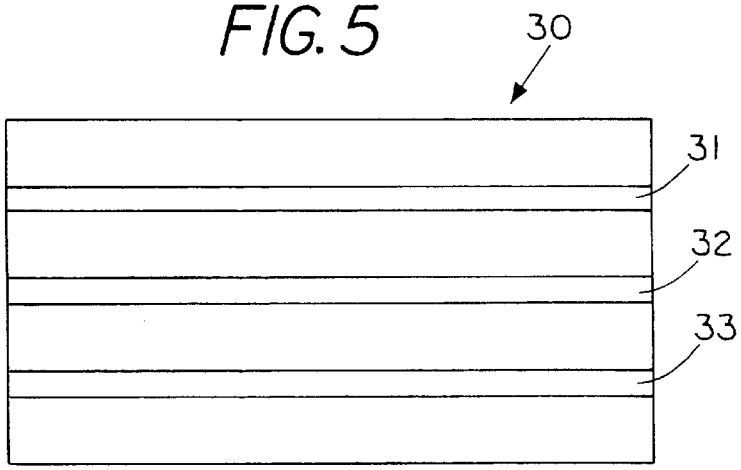
FIG. 5 is a front view of a slatboard.
Figure 6:
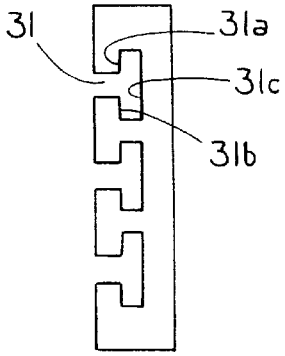
FIG. 6 is an end view of the slatboard of FIG. 5.

FIG. 5 shows the slatboard 30 having a series of T-shaped elongated slots 31, 32, and 33 located therein for supporting anchor block 10 when anchor block 10 engages hanger 20. Slot 31 is shown in end view in FIG. 6 and includes an upper front lip surface 31*a,* a lower lip surface 31*b* and a back surface 31*c*. The lips of slatboard 30 allows slatboard 30 to frictionally engage anchor block 20.

Figure 7:
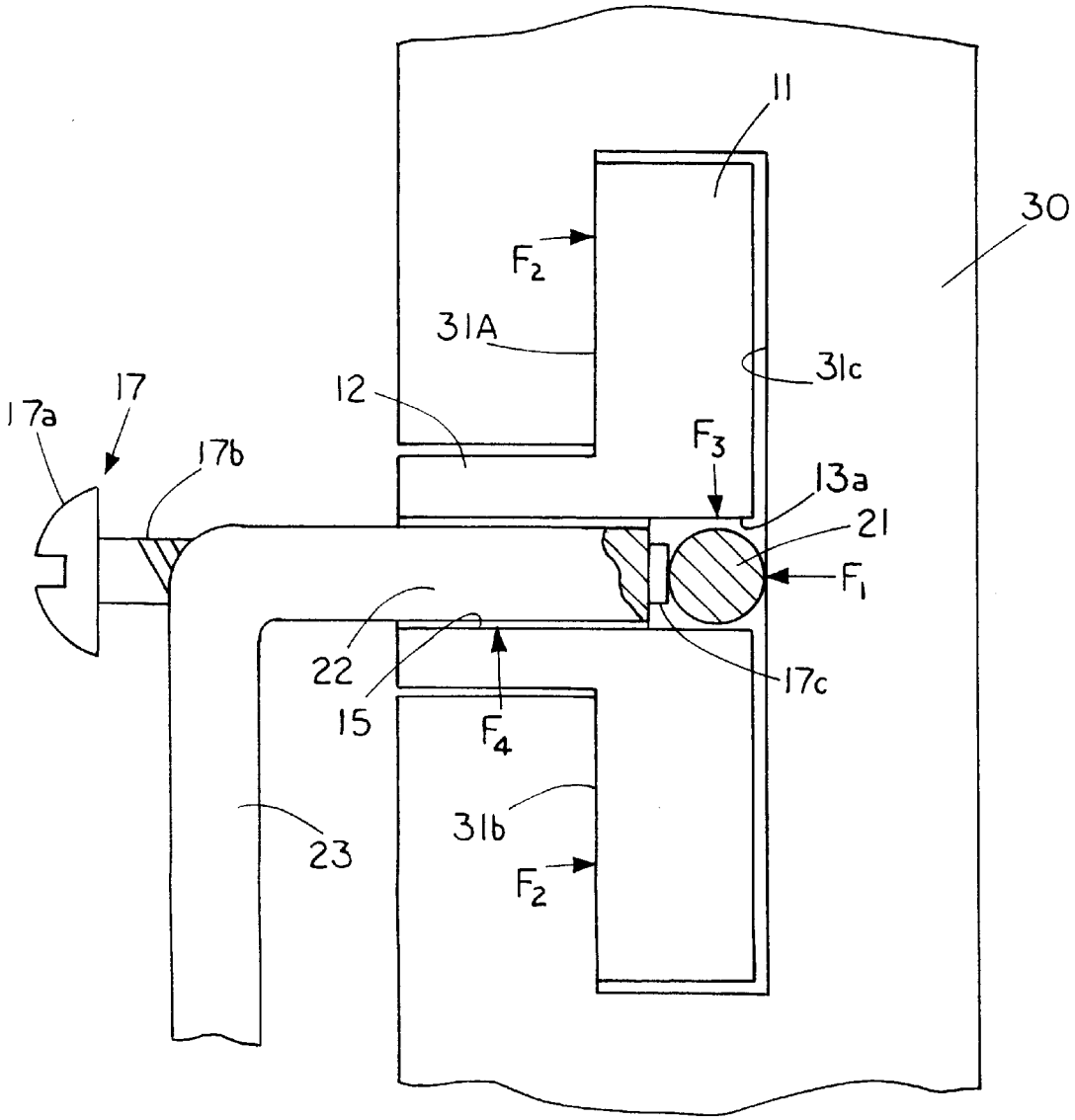
FIG. 7 is an enlarged view showing the anchor block of FIGS. 1 and 2 supporting the hook of FIGS. 3 and 4 in the T-shaped slot of the slatboard of FIGS. 5 and 6.

FIG. 7 shows anchor block 11 secured within slot 31 of slatboard 30. To understand the operation tool hanger 20 is shown partially in cross section. In operation of the system the threaded fastener 17 is positioned in the threaded opening to enable the end 17*c* of the threaded fastener 17 to be brought into pressure engagement with cross arm 21 to force cross arm 21 into pressure engagement with the back surface 31*c* (indicated by force arrow $F_1$) which forces the top surface 11*a* of anchor block 10 into pressure engagement with upper lip surface 31a and lower lip surface 31*b* (indicated by force arrows $F_2$) of slatboard 30 to thereby frictionally hold the anchor block 10 in position in the slatboard.

FIG. 7 illustrates how the hook extension 22 forms a cantilevered support with ledge 15 supporting extension 22 (indicated by force arrow $F_4$) and the upper channel surface forming pressure engagement with surface 13*a* (indicated by force arrow $F_3$) to cantileverly support the tool hanger therein.

In the embodiment shown the anchor block normally has sufficient clearance between the T-shaped slot of slatboard 30 so that anchor block 10 and tool hanger 20 can freely slide therealong. When anchor block 10 and tool hanger 20 are at the proper position anchor block 10 can be secured within the confines of the T-shaped slot in slatboard 30 by having the clearance between the T-shaped slot of slatboard 30 and anchor block 10 sufficiently small so that the engagement of the threaded fastener 17 can bring the anchor block 10 into pressure engagement with the interior surfaces 31*a* and 31*b* of the T-shaped slot. FIG. 7 shows that the end of the neck 12 is located in the plane of the front surface of the slatboard 30 when the tool hanger 20 is locked in the anchor block.

Figure 8:
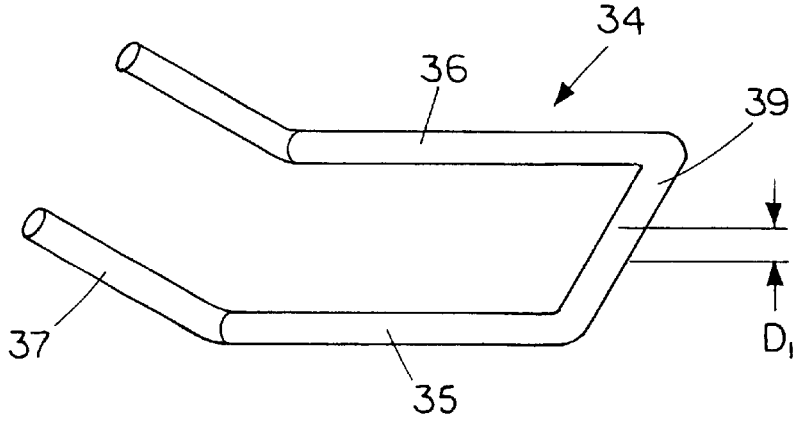
FIG. 8 is a persective view of a double straight hook having one end for engagement with the anchor block of FIG. 1 and FIG. 2 and the other end for supporting a tool thereon.

FIG. 8 shows a perspective view of a straight hook tool hanger 34 having a tool hook 36 for holding articles. Tool hanger 34 can be formed from a cylindrical member such as a wire. Tool hanger 34 has a first extension 35 and a second extension 36 with cross arm 39 extending therebetween. The extension of hanger 34 allows hanger 34 to be capable of holding articles of various sizes. Cross arm 39 also has an outside dimension of $D_1$ which is smaller than the width $D_2$ of U-shaped channel 13 to enable cross arm 39 to be snugly positioned within the elongated channel 13 while the first extension 35 is supported by first ledge 15 and second extension 36 is supported by second ledge 16 with the upper channel surface 13*a* forming a tool hook pressure surface to enable tool hanger 34 to extend in a cantilevered manner from base 11 and ledges 15 and 16.

Referring to FIG. 7 the method of forming an article hanging system comprising the steps of 1. placing cross arm 21 of tool hanger 20 within U-shape channel 13 of anchor block 10 so as to allow first extension 22 of tool hanger 20 to be supported by first ledge 15; 2. sliding anchor block 10 with the attaching tool hanger 20 into a T-shaped channel 31 located within slatboard 30; 3. sliding anchor block 10 with attaching tool hanger 20 to a desired position on slatboard 30; 4. positioning fastener 17 in a threaded opening of neck 12; and 5. rotating fastener 17 to bring fastener end 17*c* into pressure engagement with cross arm 21 to force cross arm 21 into pressure engagement with back surface 31*c* of slatboard 30 to thereby force top surface 11*a* of anchor block 10 into pressure engagement with cantilevered lip 31*a* and 31*b* of slatboard 30 so as to frictionally hold anchor block 10 in position in slatboard 30.

Figure 9:
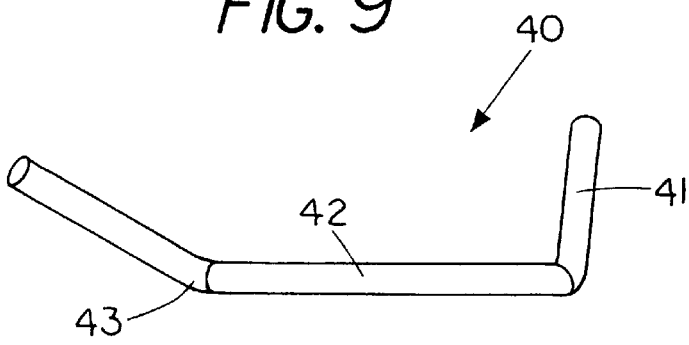
FIG. 9 shows a perspective view of a straight hook hangers having one hook.
Figure 10:
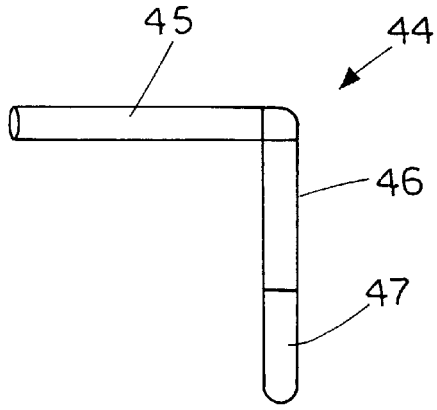
FIG. 10 shows a front view of a J-hook tool hanger having one hook.

FIG. 9 shows an alternative embodiment of a straight hook tool hanger 40 having an arm 41 with one extension 42 and one hook 43 for holding articles. FIG. 10 shows an alternative embodiment of a J-hook tool hanger 44 having an arm 45 with one extension 46 and one hook 47 for holding articles. While the preferred embodiment shows a double hook tool hanger, a one hook embodiment of the tool hanger could still be used since the cross arm of the single hook tool hanger is also positionable within channel 13 (referring to FIG. 2) of the anchor block and securable to slatboard 30 (referring to FIG. 7) by pressure engagement of a fastener.

The present invention is thus an innovative way to organize and hang tools by using an anchor block system in which various types of tool hanger can be placed within the U-shape channel of the anchor blocks. The anchor blocks and hooks are then slipped into slots located within the slatboard and are secured to the slatboard by the pressure engagement of a threaded fastener and the back side of the slot allowing an article to be hung on the slatboard.

What is claimed is:

1. A system for holding and hanging a plurality of articles comprising:

a slatboard engaging anchor block, said anchor block having a base, said base having a top surface and a bottom surface, said base having an upper surface, a lower surface and a back surface forming an elongated cross arm holding U-shaped channel, said elongated U-shaped channel extending in a transverse direction to said base, said anchor block having a neck, said neck extending from said base, said neck having a fastener guiding opening extending through said neck and said base with said opening terminating at said elongated channel, said anchor block having a ledge located on said neck, said ledge forming a first support surface;

a tool hanger, said tool hanger having a tool hook for holding articles, said tool hanger having a cylindrical member having an extension with a cross arm extending at a right angle to said extension for supporting said tool hanger, said cross arm having an outside dimension $D_1$ smaller than a width of said U-shaped channel $D_2$ to enable said cross arm to be positioned within said elongated channel while said extension is supported by said ledge with the upper surface forming a cross arm support to enable said tool hanger to extend in a cantilevered manner from said base and said ledge;

a slatboard having a plurality of elongated anchoring block support channels therein with said slatboard having a first cantilevered lip and a second cantilevered lip, a back surface to secure said anchor block within said channels; and a fastener, said fastener positioned in the fastener guiding opening to enable said fastener to be brought into pressure engagement with said cross arm to force the cross arm into pressure engagement with said back surface in said slatboard to thereby force the top surface of said anchor block into pressure engagement with said cantilevered lips of said slatboard to thereby frictionally hold the anchor block in position in said slatboard.

2. The system claimed in claim 1 wherein said fastener guiding opening has a threaded sidewall.

3. The system claimed in claim 2 wherein said fastener is a threaded fastener.

4. The system claimed in claim 1 including a second ledge located on said neck, said second ledge forming a second support surface.

5. The system claimed in claim 4 wherein said tool hanger includes a second extension, said second extension positioned on said tool hanger so that cross arm extends between said first extension and said second extension, said second extension supported by said second ledge.

6. The system claimed in claim 1 wherein said neck extends from said base so as to form a T-shape.

7. The system claimed in claim 6 wherein said channel of slat board being T-shaped channels with said slatboard having said back surface and said cantilevered lips and for supporting said anchor block within said slatboard.

8. A slatboard anchor system for holding tools comprising:

a slatboard having a plurality of elongated anchor block supporting T-shaped channels therein with said slatboard having cantilevered lips and a back surface;

an anchor block for engagement with said slatboard, said anchor block having a base, said base for engaging the lips of said slatboard, said base having a cross arm supporting channel, said anchor block having a neck, said neck extending from said base, said neck having a threaded opening extending through said base with said threaded opening terminating at said elongated channel, said anchor block having a ledge forming a support surface;

a tool hanger for holding an article, said tool hanger having a cross arm extending therefrom, said cross arm having an outside dimension less than a width of said channel to enable said cross arm to be positioned within said elongated channel while said extension is supported by said ledge and said cross arm is supported by an upper channel surface to enable said tool hanger to extend in a cantilevered manner from said base and said ledge; and a threaded fastener, said threaded fastener positioned in the threaded opening to enable said threaded fastener to be brought into pressure engagement with said cross arm to force the cross arm into pressure engagement with said back surface in said slatboard and force said anchor block into pressure engagement with said lips of said slatboard to thereby frictionally hold the anchor block in position in said slatboard.

9. A slatboard anchor block for holding articles comprising:

a base, said base having a top surface for engaging a slatboard, said base having an elongated cross arm supporting channel with an upper surface, said channel extending transverse to said base, said anchor block having a ledge for forming a support surface so that a tool holder can be cantileverly supported by coaction with said upper surface and said ledge.

10. The anchor block of claim 9 including a threaded opening in said base and a threaded fastener positioned therein to enable a person to secure the anchor block to a slatboard by rotation of said threaded fastener in a first direction and to release the anchor block by rotation of the fastener in the opposite direction.

11. A method of forming an article hanging system comprising:

placing a cross arm of a tool hanger within a channel of an anchor block so as to allow a first extension of said tool hanger to be supported by a ledge of the anchor block;

sliding said anchor block with the attaching tool hanger to a desired position in a slatboard;

positioning a fastener in the opening of a neck of said anchor block; and bringing said fastener into pressure engagement with said cross arm to force the cross arm into pressure engagement with a back surface of said slatboard to thereby force said anchor block into pressure engagement with said slatboard to thereby frictionally hold the anchor block in position in said slatboard.

* * * * *